US010526940B2

(12) United States Patent
Ishikawa et al.

(10) Patent No.: US 10,526,940 B2
(45) Date of Patent: Jan. 7, 2020

(54) BLOW-BY GAS TREATMENT DEVICE FOR INTERNAL COMBUSTION ENGINE

(71) Applicant: TOYOTA JIDOSHA KABUSHIKI KAISHA, Toyota-shi (JP)

(72) Inventors: Masami Ishikawa, Aichi-ken (JP); Shigeru Shibanuma, Nisshin (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 16/240,829

(22) Filed: Jan. 7, 2019

(65) Prior Publication Data

US 2019/0234261 A1 Aug. 1, 2019

(30) Foreign Application Priority Data

Feb. 1, 2018 (JP) ..... 2018-016485

(51) Int. Cl.
*F01M 13/02* (2006.01)
*F02M 35/10* (2006.01)
*F02M 25/06* (2016.01)

(52) U.S. Cl.
CPC ..... *F01M 13/021* (2013.01); *F02M 25/06* (2013.01); *F02M 35/1038* (2013.01); *F02M 35/10222* (2013.01)

(58) Field of Classification Search
CPC .. F01M 13/021; F01M 13/022; F01M 13/023; F01M 13/025; F01M 13/0033; F01M 2013/0038; F01M 2013/027; F02M 35/1038; F02M 35/10222; F02M 26/06
See application file for complete search history.

(56) References Cited

U.S. PATENT DOCUMENTS

| | | | | |
|---|---|---|---|---|
| 5,897,597 | A * | 4/1999 | O'Daniel | G01M 3/025 123/574 |
| 6,098,603 | A | 8/2000 | Maegawa et al. | |
| 6,247,464 | B1 | 6/2001 | Maegawa et al. | |
| 2001/0010214 | A1 | 8/2001 | Maegawa et al. | |
| 2013/0233287 | A1* | 9/2013 | Leone | F02M 25/08 123/520 |
| 2013/0282255 | A1 | 10/2013 | Pursifull | |
| 2014/0076249 | A1 | 3/2014 | Rollinger et al. | |
| 2014/0081549 | A1 | 3/2014 | Rollinger et al. | |
| 2014/0081550 | A1 | 3/2014 | Jentz et al. | |
| 2014/0081551 | A1 | 3/2014 | Rollinger et al. | |
| 2014/0081564 | A1 | 3/2014 | Pursifull et al. | |
| 2015/0081548 | A1 | 3/2015 | Robinett | |

FOREIGN PATENT DOCUMENTS

| | | |
|---|---|---|
| JP | 3-172524 | 7/1991 |
| JP | 10-184336 | 7/1998 |

* cited by examiner

*Primary Examiner* — Jacob M Amick
(74) *Attorney, Agent, or Firm* — Oblon, McClelland, Maier & Neustadt, L.L.P.

(57) ABSTRACT

A blow-by gas treatment device causes blow-by gas in a space defined by a cylinder head and a head cover in an internal combustion engine to flow back into an intake pipe. The blow-by gas treatment device includes a pipe joint and a blow-by gas pipe connected to the intake pipe. The pipe joint includes a basal end connected to the head cover, a distal end, a sensor-connected part connected to the pressure sensor, and a constriction located closer to the basal end than the sensor-connected part. The blow-by gas pipe is connected to a position of the pipe joint closer to the distal end than the sensor-connected part.

9 Claims, 1 Drawing Sheet

BLOW-BY GAS TREATMENT DEVICE FOR INTERNAL COMBUSTION ENGINE

BACKGROUND

1. Field

The present disclosure relates to a blow-by gas treatment device for an internal combustion engine.

2. Description of Related Art

Blow-by gas that has leaked from the combustion chamber of an internal combustion engine into the crankcase flows through a communication passage extending across the cylinder block and the cylinder head into a space defined by the cylinder head and the head cover. Japanese Laid-Open Patent Publication No. 10-184336 describes a blow-by gas treatment device for an internal combustion engine that causes blow-by gas that has flowed into a head cover to flow back into an intake pipe through a blow-by gas passage connected to the head cover and the intake pipe.

In the blow-by gas treatment device of the above-described document, the blow-by gas passage includes a blow-by gas valve. Further, a pressure sensor that detects the pressure in the blow-by gas passage is connected to a part of the blow-by gas passage between a portion connected to the intake pipe and the blow-by gas valve. Variation of the pressure in the blow-by gas passage detected by the pressure sensor is used to determine whether or not an anomaly such as breakage of the blow-by gas passage has occurred.

The blow-by gas passage can come off from the head cover. In this case, the blow-by gas passage remains connected to the intake pipe. Thus, even if the blow-by gas passage comes off from the head cover, the pressure detected by the pressure sensor, which is connected to the blow-by gas passage, is less likely to vary. Accordingly, it is difficult to detect coming-off of the blow-by gas passage from the head cover based on the variation of the pressure detected by the pressure sensor.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

A blow-by gas treatment device that solves the above-described problem causes blow-by gas in a space defined by a cylinder head and a head cover in an internal combustion engine to flow back into an intake pipe. The blow-by gas treatment device includes a pipe joint configured so that an inside of the pipe joint communicates with the space and includes a blow-by gas pipe connected to the intake pipe. The pipe joint includes a basal end connected to the head cover, a distal end located on a side opposite to the basal end, a sensor-connected part configured to be connected to the pressure sensor, and a constriction located closer to the basal end than the sensor-connected part. The blow-by gas pipe is connected to a position of the pipe joint closer to the distal end than the sensor-connected part.

Other features, aspects, and advantages will become apparent from the following description, taken in conjunction with the accompanying drawings, and the claims.

DETAILED DESCRIPTION

Figure 1:
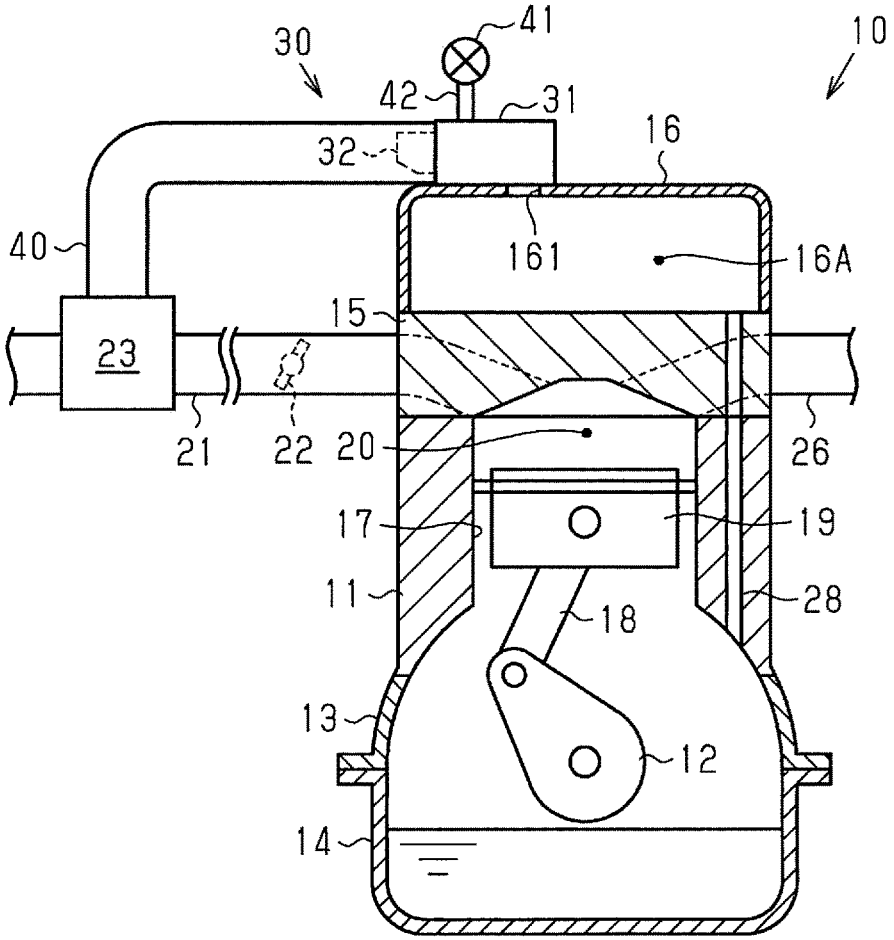
FIG. 1 is a schematic cross-sectional view showing an internal combustion engine that includes a blow-by gas treatment device according to an embodiment.

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed as will be apparent to one of ordinary skill in the art, with the exception of operations necessarily occurring in a certain order. Also, descriptions of functions and constructions that are well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art.

Unless indicated otherwise, a statement that a first layer is "on" or "connected to" a second layer or a substrate is to be interpreted as covering both a case where the first layer directly contacts the second layer or the substrate, and a case where one or more other layers are disposed between the first layer and the second layer or the substrate.

Words describing relative spatial relationships, such as "below", "beneath", "under", "lower", "bottom", "above", "over", "upper", "top", "left", and "right", may be used to conveniently describe spatial relationships of one device or elements with other devices or elements. Such words are to be interpreted as encompassing a device oriented as illustrated in the drawings, and in other orientations in use or operation. For example, an example in which a device includes a second layer disposed above a first layer based on the orientation of the device illustrated in the drawings also encompasses the device when the device is flipped upside down in use or operation.

A blow-by gas treatment device for an internal combustion engine according to an embodiment will now be described with reference to FIGS. 1 and 2.

FIG. 1 shows an internal combustion engine 10 including a blow-by gas treatment device 30 of the present embodiment. As shown in FIG. 1, a crankcase 13 is attached to the lower part of a cylinder block 11 of the internal combustion engine 10. The crankcase 13 accommodates a crankshaft 12. An oil pan 14 is attached to the crankcase 13. The oil pan 14 stores oil that circulates in the internal combustion engine 10. A cylinder head 15 is coupled to the upper part of the cylinder block 11. A head cover 16 is attached to the cylinder head 15.

The cylinder block 11 internally includes a cylinder 17. The cylinder 17 accommodates a piston 19 coupled to the crankshaft 12 by a connecting rod 18. Reciprocation of the piston 19 in the cylinder 17 rotates the crankshaft 12.

A combustion chamber 20 is defined by the circumferential wall of the cylinder 17, the piston 19, and the cylinder head 15. An intake pipe 21 is connected to the cylinder head 15. Intake air drawn into the combustion chamber 20 flows through the intake pipe 21. In the combustion chamber 20, the intake air drawn through the intake pipe 21 and a mixture of air and fuel are burned. Burning the air-fuel mixture generates exhaust gas. An exhaust pipe 26 is connected to the cylinder head 15. The exhaust gas generated in the combustion chamber 20 flows through the exhaust pipe 26.

The space defined by the cylinder head 15 and the head cover 16 is a cover inner space 16A. The internal combustion engine 10 includes a communication passage 28 through which the inside of the crankcase 13 communicates with the cover inner space 16A. The communication passage 28 extends across the cylinder block 11 and the cylinder head 15. Blow-by gas that has leaked from the combustion chamber 20 into the crankcase 13 flows through the communication passage 28 into the cover inner space 16A.

As shown in FIG. 1, the blow-by gas treatment device 30 includes a pipe joint 31 and a blow-by gas pipe 40. The basal end of the pipe joint 31 is connected to the head cover 16. The blow-by gas pipe 40 is connected to the distal end of the pipe joint 31. The blow-by gas pipe 40 is connected to the head cover 16 by the pipe joint 31. The pipe joint 31 is located on the head cover 16. More specifically, the pipe joint 31 is integrated with the head cover 16. The basal end of the pipe joint 31 is connected to a through-hole 161 extending through the head cover 16. The inside of the pipe joint 31 communicates with the cover inner space 16A through the through-hole 161. That is, the basal end of the pipe joint 31 corresponds to the upstream end of the pipe joint 31 in a direction in which blow-by gas flows. The distal end of the pipe joint 31 corresponds to the downstream end of the pipe joint 31 in the direction in which blow-by gas flows. Further, a pressure sensor 41 that detects the pressure in the pipe joint 31 is connected to the pipe joint 31.

As described above, a first end of the blow-by gas pipe 40 is connected to the distal end of the pipe joint. A second end of the blow-by gas pipe 40 is connected to a part of the intake pipe 21 located on the intake upstream side of a throttle valve 22. More specifically, the second end of the blow-by gas pipe 40 is connected to an air cleaner 23 located on the intake pipe 21. Thus, blow-by gas that has flowed into the cover inner space 16A flows through the pipe joint 31 into the blow-by gas pipe 40 and flows back through the blow-by gas pipe 40 into the air cleaner 23, that is, into the intake pipe 21.

Figure 2:
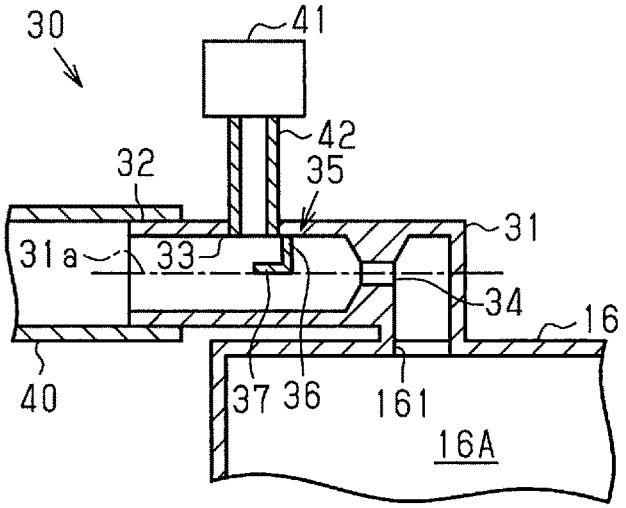
FIG. 2 is a cross-sectional view showing part of the blow-by gas treatment device of FIG. 1.

As shown in FIG. 2, the distal end (left end in FIG. 2) of the pipe joint 31 is a connection portion 32 to which the blow-by gas pipe 40 is connected. Further, the pipe joint 31 includes a sensor-connected part 33 to which the pressure sensor 41 is attached. The sensor-connected part 33 is located closer to the basal end of the pipe joint 31 than the connection portion 32 (at the right of the connection portion 32 in FIG. 2), that is, between the distal end and the basal end of the pipe joint 31. In addition, the pipe joint 31 includes a constriction 34 that has a smaller cross-sectional flow area in the pipe joint 31 than other sections. The constriction 34 is located closer to the basal end of the pipe joint 31 than the sensor-connected part 33, that is, between the sensor-connected part 33 and the basal end of the pipe joint 31.

The sensor-connected part 33 is located above a center axis 31*a* of the pipe joint 31. A tubular union 42 is connected to the sensor-connected part 33. The union 42 extends upward from the sensor-connected part 33. The inside of the union 42 communicates with the inside of the pipe joint 31. The pressure sensor 41 is attached to the upper end of the union 42. That is, in the present embodiment, the pressure sensor 41 is connected to the pipe joint 31 by the union 42 and located above the sensor-connected part 33 of the pipe joint 31.

In addition to blow-by gas, oil may remain in the cover inner space 16A and enter the pipe joint 31 together with blow-by gas. In the present embodiment, the pipe joint 31 internally includes a restriction wall 35 that restricts oil that has entered the pipe joint 31 from entering the union 42.

As shown in FIG. 2, the union 42 is connected to the upper part of the circumferential wall of the pipe joint 31. Thus, the restriction wall 35 is located at the upper part of the inside of the pipe joint 31. More specifically, the restriction wall 35 includes a first wall portion 36 extending downward from the upper part of the circumferential wall of the pipe joint 31 and a second wall portion 37 connected to the lower end of the first wall portion 36. The upper part of the circumferential wall of the pipe joint 31 is located above the center axis 31*a* of the pipe joint 31. The first wall portion 36 is located closer to the constriction 34 than the union 42, that is, located between the union 42 and the constriction 34. The second wall portion 37 extends from the lower end of the first wall portion 36 toward a side opposite to the constriction 34, that is, toward the connection portion 32 (left side in FIG. 2).

The operation and advantages of the present embodiment will now be described.

When the engine is running, since blow-by gas flows through the blow-by gas pipe 40 into the intake pipe 21, the pressure in the blow-by gas pipe 40 is negative pressure. The region in the pipe joint 31 from the constriction 34 to the distal end communicates with the inside of the blow-by gas pipe 40. Thus, the pressure detected by the pressure sensor 41, that is, the pressure of the region in the pipe joint 31 from the constriction 34 to the distal end is also negative pressure.

In such a situation, coming-off of the blow-by gas pipe 40 from the pipe joint 31 exposes, to the atmosphere, the region in the pipe joint 31 from the constriction 34 to the distal end. Thus, the pressure of the region changes from negative pressure to the atmospheric pressure. In the present embodiment, such a pressure change is detected by the pressure sensor 41. Thus, based on the variation in pressure detected by the pressure sensor 41, coming-off of the blow-by gas pipe 40 from the head cover 16 can be detected.

In the present embodiment, the pressure sensor 41 is connected to the pipe joint 31 by the union 42. This allows the pressure sensor 41 to be located away from the inside of the pipe joint 31. Consequently, as compared to when the pressure sensor 41 is directly attached to the pipe joint 31, oil that has entered the pipe joint 31 from the cover inner space 16A together with blow-by gas is less likely to collect on the pressure sensor 41. This limits decreases in the detection accuracy of pressure with the pressure sensor 41 that result from collection of foreign matter such as oil on the pressure sensor 41.

Further, in the present embodiment, the pressure sensor 41, which is connected to the pipe joint 31 by the union 42, is located above the pipe joint 31. That is, the union 42 extends upward from the sensor-connected part 33. Thus, even if oil enters the union 42, the oil is unlikely to reach the pressure sensor 41. In short, the effect of limiting collection of oil on the pressure sensor 41 is increased by gravitational force.

Additionally, the union 42 is connected to the part of the pipe joint 31 located above the center axis 31*a*. This limits entry of oil from the pipe joint 31 into the union 42. Thus, the effect of limiting collection of oil on the pressure sensor 41 is further increased.

Furthermore, in the present embodiment, the restriction wall 35 in the pipe joint 31 restricts oil that has entered the pipe joint 31 from entering into the union 42. Thus, the effect of limiting collection of oil on the pressure sensor 41 is further increased.

It should be apparent to those skilled in the art that the present invention may be embodied in many other specific forms without departing from the spirit or scope of the invention. Particularly, it should be understood that the present invention may be embodied in the following forms.

The shape of a restriction wall may be different from that of the restriction wall 35 according to the above-described embodiment. For example, the restriction wall does not have to include the second wall portion 37.

The restriction wall 35 does not have to be located in the pipe joint 31.

The union 42 may be connected to the pipe joint 31 such that the union 42 extends in a direction that intersects the vertical direction. Even such a structure allows the pressure sensor 41 to be located above the part of the pipe joint 31 connected to the union 42.

The pressure sensor 41 does not have to be located above the part of the pipe joint 31 connected to the union 42. Instead, for example, the pressure sensor 41 may be located at the same position as the part of the pipe joint 31 connected to the union 42 in the vertical direction. As another option, the pressure sensor 41 may be located below the part of the pipe joint 31 connected to the union 42.

The pressure sensor 41 may be directly attached to the pipe joint 31 without the union 42. Even in such a structure, the variation of pressure detected by the pressure sensor 41 allows for detection of coming-off of the blow-by gas pipe 40 from the pipe joint 31.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

The invention claimed is:

1. A blow-by gas treatment device that causes blow-by gas in a space defined by a cylinder head and a head cover in an internal combustion engine to flow back into an intake pipe, the blow-by gas treatment device comprising:

a pipe joint configured so that an inside of the pipe joint communicates with the space, the pipe joint including
- a basal end connected to the head cover,
- a distal end located on a side opposite to the basal end,
- a sensor-connected part configured to be connected to a pressure sensor, and
- a constriction located closer to the basal end than the sensor-connected part; and a blow-by gas pipe connected to a position of the pipe joint closer to the distal end than the sensor-connected part and connected to the intake pipe.

2. The blow-by gas treatment device according to claim 1, further comprising a union extending from the sensor-connected part, wherein an inside of the union communicates with an inside of the pipe joint, and the pressure sensor is connected to the pipe joint by the union.

3. The blow-by gas treatment device according to claim 2, wherein the union is configured so that the pressure sensor is located above the sensor-connected part.

4. The blow-by gas treatment device according to claim 3, wherein the union extends upward from the sensor-connected part.

5. The blow-by gas treatment device according to claim 2, wherein the sensor-connected part is located above a center axis of the pipe joint.

6. The blow-by gas treatment device according to claim 2, wherein the pipe joint further includes a restriction wall configured to restrict oil from entering the union, wherein the restriction wall is located in the pipe joint.

7. The blow-by gas treatment device according to claim 6, wherein the restriction wall includes a first wall portion located closer to the constriction than the sensor-connected part.

8. The blow-by gas treatment device according to claim 6, wherein the restriction wall includes a first wall portion located closer to the constriction than the sensor-connected part, and a second wall portion extending from the first wall portion toward a side opposite to the constriction.

9. A blow-by gas treatment device that causes blow-by gas in a space defined by a cylinder head and a head cover in an internal combustion engine to flow back into an intake pipe, the blow-by gas treatment device comprising:

a blow-by gas pipe connected to the intake pipe; and a pipe joint located on the head cover so that an inside of the pipe joint communicates with the space, the pipe joint including
- a basal end connected to the head cover,
- a distal end connected to the blow-by gas pipe,
- a sensor-connected part located between the basal end and the distal end, wherein the sensor-connected part is configured to be connected to a pressure sensor, and
- a constriction located between the sensor-connected part and the basal end.

* * * * *